US008837996B2

(12) United States Patent
Nishida et al.

(10) Patent No.: US 8,837,996 B2
(45) Date of Patent: Sep. 16, 2014

(54) IMAGE FORMING APPARATUS

(75) Inventors: Satoshi Nishida, Saitama (JP); Hideo Yamaki, Hachioji (JP); Yusuke Nishisaka, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 116 days.

(21) Appl. No.: 13/450,776

(22) Filed: Apr. 19, 2012

(65) Prior Publication Data

US 2012/0275829 A1 Nov. 1, 2012

(30) Foreign Application Priority Data

Apr. 27, 2011 (JP) ..... 2011-098896

(51) Int. Cl.
*G03G 15/01* (2006.01)

(52) U.S. Cl.
USPC ..... 399/302

(58) Field of Classification Search
CPC ..... G03G 13/00; G03G 15/00; G03G 15/162; G03G 15/1615; G03G 15/0189; G03G 15/1605
USPC ..... 399/302, 66
See application file for complete search history.

(56) References Cited

U.S. PATENT DOCUMENTS

| | | | | |
|---|---|---|---|---|
| 8,385,793 | B2 * | 2/2013 | Furuya et al. | 399/302 |
| 2004/0013452 | A1 * | 1/2004 | Choi | 399/313 |
| 2009/0208259 | A1 * | 8/2009 | Ishikawa | 399/313 |
| 2009/0317108 | A1 * | 12/2009 | Taki et al. | 399/66 |

FOREIGN PATENT DOCUMENTS

| | | | |
|---|---|---|---|
| JP | 07092843 | A | 4/1995 |
| JP | 09080926 | A | 3/1997 |
| JP | 2000293066 | A | 10/2000 |
| JP | 2003173092 | A | 6/2003 |
| JP | 2006-139168 | A | 6/2006 |
| JP | 2009-63794 | A | 3/2009 |
| JP | 2009-186828 | A | 8/2009 |
| JP | 2010-2838 | A | 1/2010 |
| JP | 2010-72311 | A | 4/2010 |
| JP | 2010-139603 | A | 6/2010 |
| JP | 2010134167 | A | 6/2010 |

OTHER PUBLICATIONS

Machine translation of JP 2000293066 A, publication date: Oct. 20, 2000.*

(Continued)

*Primary Examiner* — Walter L Lindsay, Jr.
*Assistant Examiner* — Frederick Wenderoth
(74) *Attorney, Agent, or Firm* — Cantor Colburn LLP

(57) ABSTRACT

An image forming apparatus includes a transfer belt, a pressure receiving roller, a secondary transfer roller, and a belt movement restricting section. The belt movement restricting section is disposed close to the back of the belt. When pressing the belt between the pressure receiving roller and the secondary transfer roller, and nipping paper between the belt and the secondary transfer roller, an angle defined by the portion, upstream from the secondary transfer roller, of the belt and an imaginary line connecting the pressure-receiving-roller axis with the secondary-transfer-roller axis is less than 90 degrees. During non-secondary-transfer mode, the belt movement restricting section is separated from the belt. During secondary transfer, the belt movement restricting section holds the belt not to let the belt pushed by the paper move toward the pressure receiving roller.

7 Claims, 11 Drawing Sheets

(56) References Cited

OTHER PUBLICATIONS

Machine translation of JP 09080926 A, publication date: Mar. 28, 1997.*
Machine translation of JP 2003173092, publication date: Jun. 20, 2003.*
Notification of Reasons for Refusal for Japanese Application No. 2011-098897; Date of Mailing; May 14, 2013 with English Translation.
Notification of Reasons for Refusal for Japanese Application No. 2011-098896; Date of Mailing: May 21, 2013 with English Translation.
Japanese Office Action for Application No. 2011-098897; Date of Mailing, Jan. 7, 2014, with English Translation.
Non Final Office Action for U.S. Appl. No. 13/450,735, dated Jan. 16, 2014.

* cited by examiner

IMAGE FORMING APPARATUS

BACKGROUND OF THE INVENTION

1. Field of the Invention

The present invention relates to an image forming apparatus.

2. Description of Related Art

Typical image forming apparatuses form an image on paper by performing primarily transfer of a toner image to a surface of an endless transfer belt, which is rotatably stretched over a plurality of rollers including a drive roller, a driven roller, and a backup roller, from a photoreceptor drum (an image carrier), and then performing secondary transfer of the toner image to the paper.

Such image forming apparatuses have a secondary transfer roller that presses the transfer belt against the backup roller. When a portion of the transfer belt on which a toner image has been primarily transferred passes through the backup roller, paper is allowed to pass between the transfer belt and the secondary transfer roller, so that the toner image is secondarily transferred on the paper.

In such image forming apparatuses, electrical discharge may occur across the gap between paper and the transfer belt in the vicinity of the entrance of a transfer nip area where the transfer belt is in proximity to the secondary transfer roller, during the secondary transfer of a toner image on the transfer belt to the paper. This causes disorder of the toner image, leading to formation of an abnormal image called toner scattering.

In the case of image formation on heavy and stiff thick paper, the trailing end of the thick paper is bent by being pre-nipped between the transfer belt and the secondary transfer roller, and the trailing end may hit the transfer belt as a reaction of its restoration. The transfer belt inwardly deflects due to the shock of such hitting, resulting in formation of a gap between the thick paper and the transfer belt. Electrical discharge may occur across the gap, leading to formation of the above-described abnormal image.

In another image forming apparatus, a position of the transfer belt is changed immediately before the thick paper passes between the transfer belt and the secondary transfer roller to reduce the shock due to hitting of the thick paper against the transfer belt (see, for example, Japanese Unexamined Patent Application Publication No. 2010-139603 (JP-A-2010-139603)).

In still another image forming apparatus, an electrode is disposed inside the transfer belt to reduce electrical discharge that may occur on the transfer belt (see, for example, Japanese Unexamined Patent Application Publication No. 2010-2838 (JP-A-2010-2838).

Unfortunately, in the image forming apparatus disclosed in JP-A-2010-139603, the thick paper still hits the transfer belt even though the shock is reduced, and thus the transfer belt still deflects inwardly and a gap is formed, resulting in occurrence of electrical discharge across the gap in some cases. In addition, if the position of the transfer belt varies, the area of paper pre-nipped between the transfer belt and the secondary transfer roller is different between before and after the variation, which may cause color or density change in the formed image.

In the image forming apparatus disclosed in JP-A-2010-2838, paper which is to be nipped for a transfer is conveyed in a direction substantially perpendicular to a line that connects the axis of the secondary transfer roller with the axis of a counter roller. Accordingly, the paper is not pre-nipped, and thus, the paper is not bent. This means that there is no possibility that the paper hits against the transfer belt with its rebound. In addition, the electrode disposed inside the transfer belt does not restrict the inward deflection of the transfer belt.

SUMMARY OF THE INVENTION

It is, therefore, a main object of the present invention to provide an image forming apparatus that can suppress the disorder of a toner image and can form excellent images.

To achieve the abovementioned object, an image forming apparatus reflecting one aspect of the present invention includes: a transfer belt having a first surface on which a toner image is primarily transferred, the transfer belt rotating in a predetermined direction; a pressure receiving roller over which the transfer belt is stretched; a secondary transfer roller that presses the transfer belt against the pressure receiving roller; and a belt movement restricting section disposed in a vicinity of a second surface of the transfer belt, the second surface being opposite from the first surface, wherein when the transfer belt is pressed between the pressure receiving roller and the secondary transfer roller, and paper is nipped between the transfer belt and the secondary transfer roller for secondary transfer of the toner image onto the paper, an angle defined by a portion, upstream from the secondary transfer roller, of the first surface and an imaginary line connecting an axis of the pressure receiving roller with an axis of the secondary transfer roller is less than 90 degrees; when the secondary transfer is not performed, the belt movement restricting section is separated from the transfer belt with a predetermined amount of space therebetween; and during the secondary transfer, the belt movement restricting section holds the transfer belt to restrict a movement of the transfer belt toward the pressure receiving roller when the transfer belt is pushed by the paper.

Preferably, in the image forming apparatus, the transfer belt comes in contact with the belt movement restricting section while the transfer belt is pressed between the pressure receiving roller and the secondary transfer roller.

Preferably, in the image forming apparatus, the belt movement restricting section includes a fixing member having a cross-sectional shape that allows the fixing member to withstand a push given by the transfer belt when the fixing member comes in contact with the transfer belt.

Preferably, in the image forming apparatus, the belt movement restricting section includes a belt movement restricting roller that rotates in response to rotation of the transfer belt when the belt movement restricting roller comes in contact with the transfer belt.

Preferably, in the image forming apparatus, the belt movement restricting section includes an endless belt and a belt movement restricting roller, the endless belt being stretched over the belt movement restricting roller, and the endless belt rotating in response to rotation of the transfer belt when the endless belt comes in contact with the transfer belt.

Preferably, in the image forming apparatus, the belt movement restricting section extends across a full width of the transfer belt.

Preferably, in the image forming apparatus, the belt movement restricting section is disposed at a position corresponding to a central portion of the transfer belt with respect to a width direction thereof.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Preferred embodiments of the present invention will now be described with reference to the accompanying drawings. Although technically preferred various restrictions are imposed to the following embodiments to carry out the present invention, the scope of the invention is not intended to be limited to the following embodiments and exemplary illustrations.

First Embodiment

Figure 1:
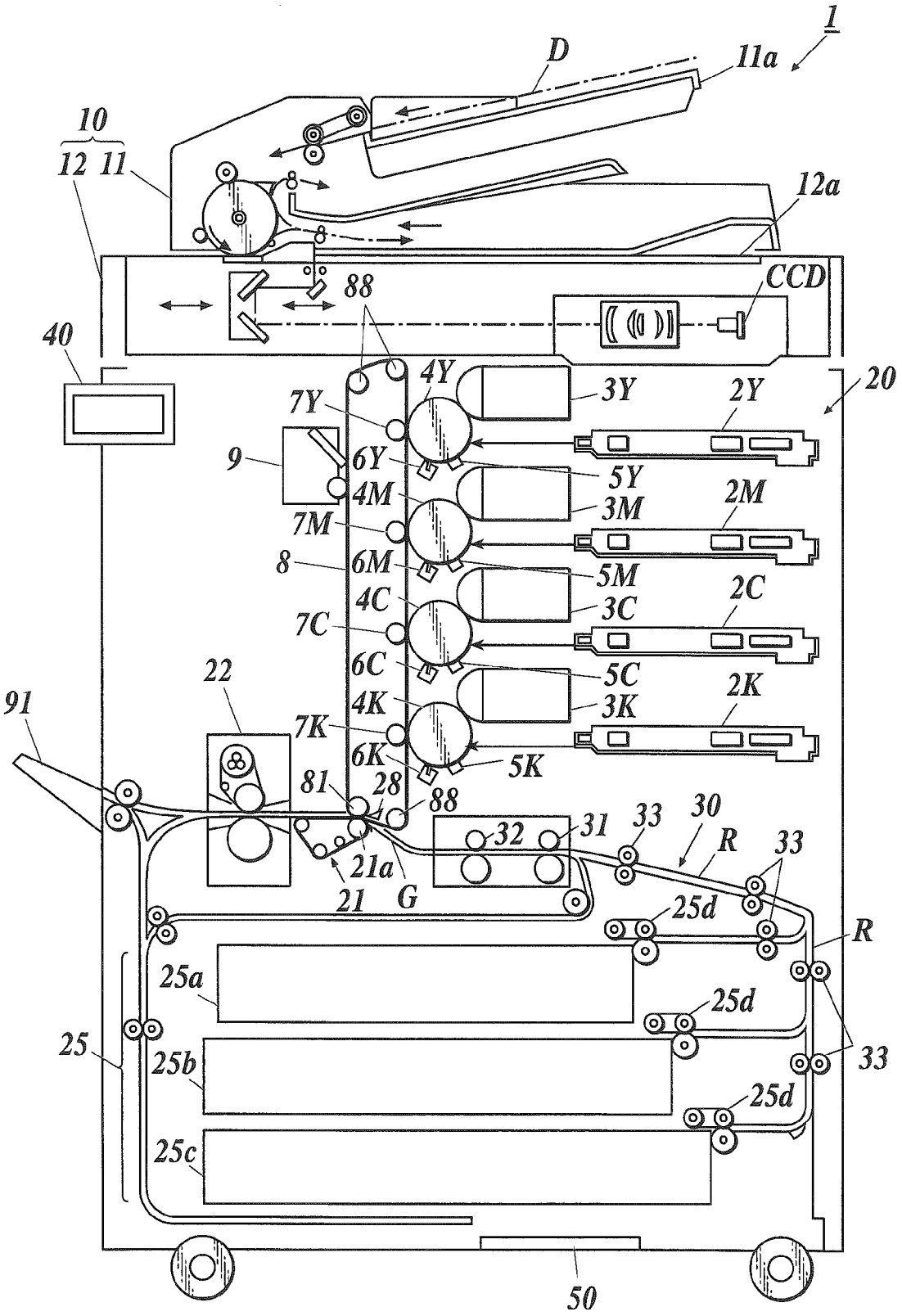
FIG. 1 is a schematic structural diagram illustrating an image forming apparatus.

FIG. 1 is a schematic structural diagram illustrating an image forming apparatus 1.

The image forming apparatus 1 has a copying function of reading an image from a document, forming an image on paper P on the basis of the read image data, and outputting the image; and a printing function of receiving page data containing image data and job data containing image forming conditions for each image data from external devices, forming an image on the paper P on the basis of the received page data and job data, and outputting the image.

As shown in FIG. 1, the image forming apparatus 1 includes an image reading unit 10, an image forming unit 20, a paper housing 25, a conveyance unit 30, an operational unit 40, and a controller 50.

The image reading unit 10 includes a document feeding section 11 called an automatic document feeder (ADF), and a reading section 12.

The reading section 12 reads an image on a document D placed on a contact glass 12*a* as a reading place with a charge coupled device (CCD).

The document D placed in a document tray 11*a* of the document feeding section 11 is conveyed onto the contact glass 12*a*, and the image or images on one or two sides of the document D are read by the CCD.

The term "image" includes text data such as letters and symbols, in addition to image data such as drawings and photographs.

The image (analog image signals) read by the image reading unit 10 is sent to a CPU (not shown) of the controller 50, and then the CPU performs various types of image processing such as analog processing, A/D conversion, shading correction, and image compression. The processed image is then separated into color components of yellow (Y), magenta (M), cyan (C), and black (K), and sent to the image forming unit 20 in the form of digital image data.

The image forming unit 20 performs electrographic image forming processing on the basis of the received image data.

The image forming unit 20 includes exposure sections 2Y, 2M, 2C, and 2K; development sections 3Y, 3M, 3C, and 3K; photoreceptor drums as image carriers 4Y, 4M, 4C, and 4K; charging sections 5Y, 5M, 5C, and 5K; cleaning sections 6Y, 6M, 6C, and 6K for the photoreceptor drums; primary transfer rollers 7Y, 7M, 7C, and 7K; a transfer belt 8; a belt movement restricting section 28; a cleaning device 9 for the transfer belt; a secondary transfer section 21; and a fixing section 22.

In the image forming unit 20, a portion where the transfer belt 8 (a backup roller 81) is pressed against the secondary transfer section 21 (a secondary transfer roller 21*a*) functions as an image transfer section that transfers an image onto paper P for image formation.

The exposure sections 2Y, 2M, 2C, and 2K are each composed of a laser light source such as a laser diode (LD), a polygon mirror, and a plurality of lenses.

The exposure sections 2Y, 2M, 2C, and 2K scan to expose surfaces of the photoreceptor drums 4Y, 4M, 4C, and 4K, respectively, with laser beams on the basis of image data sent from the controller 50. Latent images are formed on the photoreceptor drums 4Y, 4M, 4C, and 4K charged by the charging sections 5Y, 5M, 5C, and 5K, respectively, through such scanning exposure with laser beams, and thus an image is written.

The latent images formed on the photoreceptor drums 4Y, 4M, 4C, and 4K are rendered visible through development with toner held in the corresponding development sections 3Y, 3M, 3C, and 3K, respectively, so that toner images are formed on the respective photoreceptor drums 4Y, 4M, 4C, and 4K.

The toner images carried on the photoreceptor drums 4Y, 4M, 4C, and 4K are primarily transferred onto the transfer belt 8 by the primary transfer rollers 7Y, 7M, 7C, and 7K, respectively.

After transfer of the toner images, residual toner is removed from the surfaces of the photoreceptor drums 4Y, 4M, 4C, and 4K by the cleaning sections 6Y, 6M, 6C, and 6K.

The transfer belt 8 is an endless belt rotatably stretched over a plurality of rollers (for example, the backup roller 81 and a tension roller 88), and rotated clockwise in the drawing along with rotation of the rollers.

The transfer belt 8 is pressed against the photoreceptor drums 4Y, 4M, 4C, and 4K by the primary transfer rollers 7Y, 7M, 7C, and 7K, respectively. As a result, the toner images developed on the surfaces of the photoreceptor drums 4Y, 4M, 4C, and 4K are transferred onto the surface of the transfer belt 8 at the transfer positions pressed by the primary transfer rollers 7Y, 7M, 7C, and 7K, respectively (primary transfer).

In addition, the transfer belt 8 comes into tight contact with the paper P at another transfer position pressed by the backup roller 81 as a pressure receiving roller and the secondary transfer roller 21*a* of the secondary transfer section 21, so that the toner images formed through primary transfer are transferred onto the paper P (secondary transfer).

After the toner images are transferred onto the paper P by the secondary transfer section 21, the paper P is separated from the transfer belt 8 by means of a large curvature of the paper and electrostatic force, and sent to the fixing section 22.

After transfer of the toner images onto the paper P, the residual toner is removed from the transfer belt 8 by the cleaning device 9.

A fixing member 280 of the belt movement restricting section 28 is provided between the backup roller 81 and the tension roller 88 upstream from the backup roller 81 in the vicinity of the back of the transfer belt 8. The belt movement restricting section 28 (the fixing member 280) holds the transfer belt 8 to restrict a movement of the transfer belt 8 toward the backup roller 81 when the transfer belt 8 is pushed by the paper P during secondary transfer. The belt movement restricting section 28 (the fixing member 280) is separated from the transfer belt 8 with a predetermined amount of space therebetween when a secondary transfer is not performed.

The fixing member 280, which includes an insulating resin material (for example, polyoxymethylene or polyacetal (POM)), is a columnar member having a cross-sectional shape of a substantially right-angled triangle, and supported by an undepicted support.

A highly slidable film or tape (for example, Ultra Tape, manufactured by Sumitomo 3M Limited) is preferably attached on a surface 280*a* of the fixing member 280, which surface 280*a* faces the transfer belt 8. This protects the transfer belt 8 from damage when the transfer belt 8 comes in contact with the fixing member 280.

Figure 2:
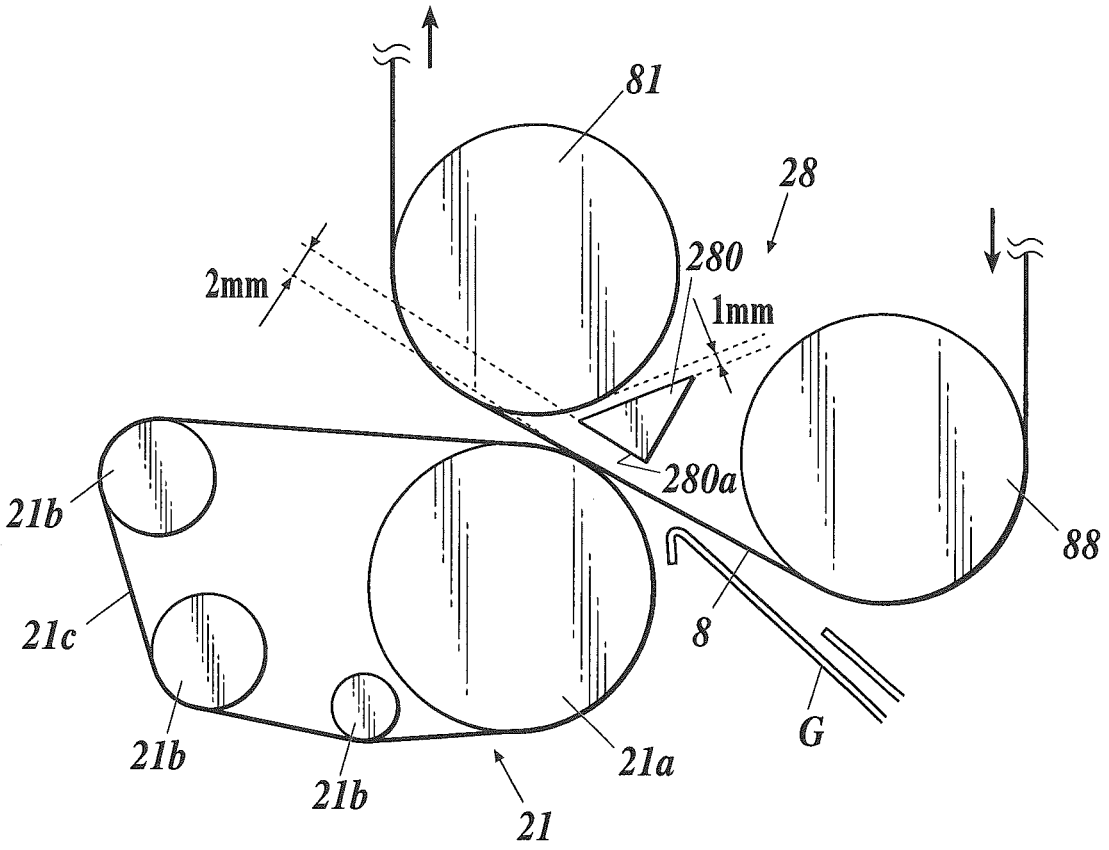
FIG. 2 is an enlarged view illustrating a belt movement restricting section of a first embodiment, showing the position of a secondary transfer roller during a non-secondary-transfer mode.
Figure 3:
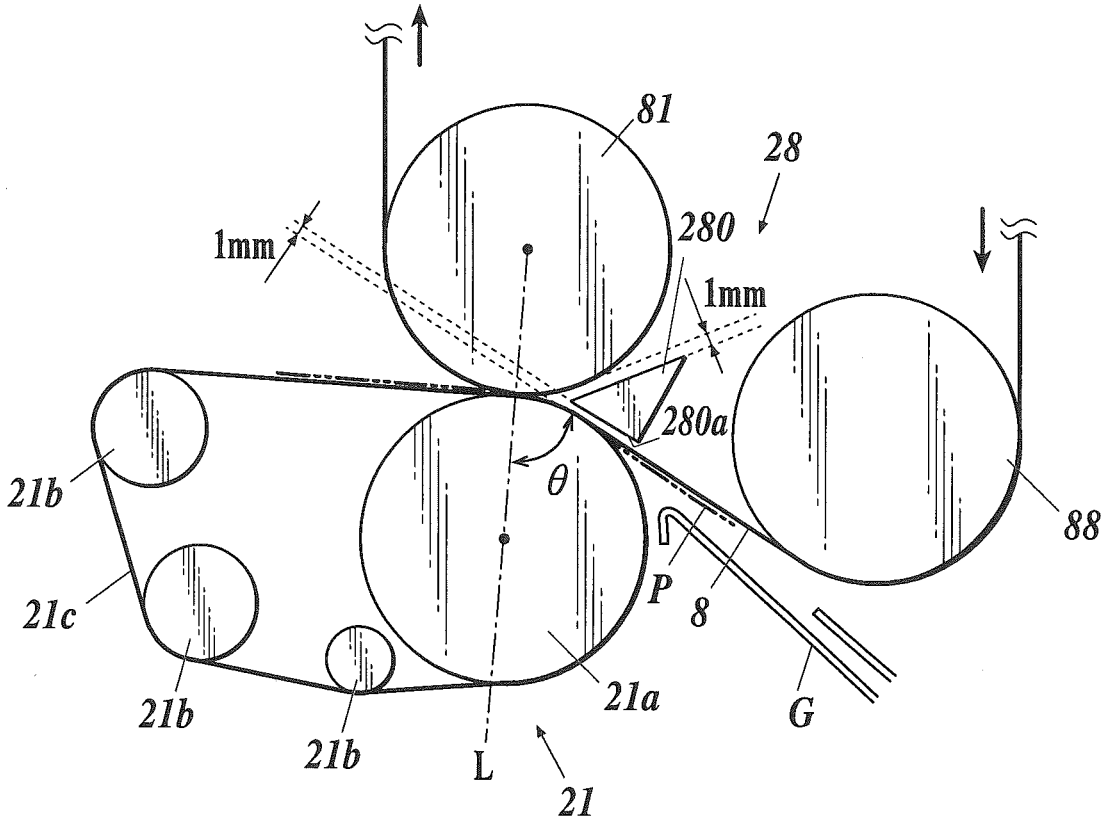
FIG. 3 is an enlarged view illustrating the belt movement restricting section of the first embodiment, showing the position of the secondary transfer roller during a secondary-transfer mode.

As shown in FIGS. 2 and 3, the secondary transfer section 21 includes the secondary transfer roller 21*a*, a plurality of tension rollers 21*b*, and an endless belt 21*c* rotatably stretched over the secondary transfer roller 21*a* and the tension rollers 21*b*.

The secondary transfer section 21 can be moved by an undepicted drive mechanism, and is arranged such that the backup roller 81 is separated from the secondary transfer roller 21*a* during a non-secondary-transfer mode (see FIG. 2), and arranged such that the transfer belt 8 is pressed by the secondary transfer roller 21*a* against the backup roller 81 during a secondary-transfer mode (see FIG. 3).

In the image forming apparatus 1, when the secondary transfer section 21 is arranged such that the transfer belt 8 is pressed between the backup roller 81 and the secondary transfer roller 21*a*, and when the paper P is nipped between the transfer belt 8 and the secondary transfer roller 21*a* for secondary transfer of the toner images onto the paper P (see FIG. 3), the angle θ defined by a portion, upstream from the secondary transfer roller 21*a*, of the surface of the transfer belt 8 and an imaginary line L (or an imaginary surface), which connects the axis of the backup roller 81 with the axis of the secondary transfer roller 21*a*, is less than 90 degrees.

Since the angle θ defined by the surface of the transfer belt 8, which is in the upstream region from the secondary transfer roller 21*a*, and the imaginary line L is less than 90 degrees as described above, the paper P is pre-nipped between the secondary transfer roller 21*a* and the transfer belt 8 along the peripheral surface of the secondary transfer roller 21*a*, and then, the paper P is nipped by the backup roller 81 and the secondary transfer roller 21*a* for transfer. The paper P is nipped for transfer while an electric field is formed between the backup roller 81 receiving a voltage and the secondary transfer roller 21*a* connected to the ground, so that the toner images is secondarily transferred.

The fixing section 22 fixes the toner images transferred on the paper P. As a result, the toner images are fixed on the paper P, resulting in formation of an image. After the fixing section 22 has fixed the toner images, the paper P is discharged to an output tray 91.

Specifically, image formation by the image forming unit 20 means sequential operation including formation of the latent images on the photoreceptor drums 4Y, 4M, 4C, and 4K with the exposure sections 2Y, 2M, 2C, and 2K, development of the toner images through application of toner to the latent images, primary transfer of the toner images onto the transfer belt 8, secondary transfer of the toner images onto the paper P, and fixing of the toner images transferred on the paper P by the fixing section 22.

The paper housing 25 includes a plurality of paper trays 25*a*, 25*b*, and 25*c* and a plurality of paper feeders 25*d*.

The paper trays 25*a*, 25*b*, and 25*c* store different types of paper which are beforehand set and identified depending on the weight or size of paper P.

The paper feeders 25*d* feed the paper P stored in each paper tray to the conveyance unit 30 one by one from the top.

The conveyance unit 30 is composed of a conveyance path R from the paper housing 25 to the image transfer section (the transfer belt 8 and the secondary transfer section 21), and a plurality of conveyance roller pairs (31, 32, and 33) disposed along the conveyance path R to convey the paper P fed from the paper housing 25 to the image transfer section. Part of the conveyance path R extends to a path from the image transfer section to the output tray 91 and a path for turning over the paper.

The conveyance unit 30 includes conveyance roller pairs including resist rollers 32 proximally disposed upstream from the image transfer section (the transfer belt 8 and the secondary transfer section 21) on the conveyance path R, loop rollers 31 proximally disposed upstream from the resist rollers 32, and feed rollers 33 disposed between the loop rollers 31 and the paper trays (the paper feeders 25*d*).

The loop rollers 31 correct crook (skew) of the paper P. In detail, the paper P passes through the loop rollers 31 and bumps against the resist rollers 32 under suspension. After bumping against the resist rollers 32, the paper P is still conveyed by the loop rollers 31 and thus curled, and the skew of the paper P is corrected in accordance with a nip line of the resist rollers 32.

The resist rollers 32 shake in a direction orthogonal to the conveyance direction of the paper P while holding the paper P being conveyed for image formation so that the paper P is aligned with the toner images primarily transferred onto the transfer belt 8.

The operational unit 40 includes, for example, a liquid crystal display panel and a touch panel provided on the screen of the liquid crystal display panel. Through a touch operation of an operational key displayed on the liquid crystal display panel, the position of a touched portion on the touch panel is detected, and an operational signal corresponding to the detected position is sent to the controller 50.

The controller 50 of the image forming apparatus 1 comprehensively controls the components of the apparatus, and is connected to the image reading unit 10, the image forming unit 20, the conveyance unit 30, and the operational unit 40.

The movement of the secondary transfer section 21 and the arrangement and function of the belt movement restricting section 28 (the fixing member 280) during image formation of the image forming apparatus 1 are now described.

As shown in FIG. 2, the secondary transfer section 21 is arranged such that the backup roller 81 is separated from the secondary transfer roller 21*a* during the non-secondary-transfer mode.

In this mode, the distance between the surface 280*a* of the fixing member 280 and the transfer belt 8 is designed to be, for example, 2 mm.

The distance between the backup roller 81 and the fixing member 280 is designed to be, for example, 1 mm. Although the fixing member 280 should preferably be disposed in proximity to the backup roller 81 from the viewpoint of design, a distance of at least about 1 mm is desirably provided therebetween to prevent the effect of the electric field from the backup roller 81 on the fixing member 280.

As shown in FIG. 3, the secondary transfer section 21 is arranged such that the transfer belt 8 is pressed between the backup roller 81 and the secondary transfer roller 21*a* during the secondary-transfer mode.

In this mode, the distance between the surface 280*a* of the fixing member 280 and the transfer belt 8 is designed to be, for example, 1 mm.

In this way, the distance between the surface 280*a* of the fixing member 280 and the transfer belt 8 is 1 mm in this embodiment. Accordingly, when the secondary transfer section 21 is arranged such that the transfer belt 8 is pressed between the backup roller 81 and the secondary transfer roller 21*a*, and when the paper P is nipped between the transfer belt 8 and the secondary transfer roller 21*a* for secondary transfer of the toner images onto the paper P, the amount of movement of the transfer belt 8 toward the backup roller 81 is limited to, at most, 1 mm even if the transfer belt 8 is pushed by the paper P.

Specifically, the paper P, which is conveyed along the conveyance path R, is nipped between the secondary transfer roller 21*a* and the transfer belt 8, and then exits from a guide G on the conveyance path R. Even if the trailing end of stiff paper P such as thick paper hits the transfer belt 8 as a reaction of its restoration at the timing of the exit, the fixing member 280 restricts the movement of the transfer belt 8 toward the backup roller 81 to at most 1 mm. In addition, deflection of the transfer belt 8 toward the backup roller 81 by about 1 mm does not form a gap that induces electrical discharge between the paper P and the transfer belt 8. As a result, the disorder of the toner image due to the electrical discharge does not occur, leading to preferable image formation based on excellent secondary transfer.

In particular, the fixing member 280 has a cross-sectional shape that allows the fixing member 280 to withstand the push given by the transfer belt 8 even when the transfer belt 8 is deflected by about 1 mm due to the shock caused by hitting of the trailing end of the stiff paper P against the transfer belt 8.

In detail, the fixing member 280 is a columnar member having a surface that substantially perpendicularly meets the surface 280*a* facing the transfer belt 8, and having a cross-sectional shape of a substantially right-angled triangle. Thus, the fixing member 280 is not easily deformed when pushed by the transfer belt 8. In addition, the fixing member 280 can restrict the movement of the transfer belt 8 toward the backup roller 81 to, at most, 1 mm while withstanding the push given by the transfer belt 8.

Since the fixing member 280 has an inclined surface facing the backup roller 81, the apex of a corner of the fixing member 280 is disposed in a space between the backup roller 81 and the transfer belt 8. Thereby, the fixing member 280 can be disposed in proximity to the backup roller 81.

In contrast, if the fixing member 280 (the belt movement restricting section 28) is not provided as in the conventional technology, the transfer belt 8 may be deflected by 3 to 5 mm due to hitting of the trailing end of the stiff paper P against the transfer belt 8, so that a gap to induce electrical discharge is formed between the paper P and the transfer belt 8. This causes disorder of the toner image, leading to formation of an abnormal image.

As described above, the image forming apparatus 1 of the first embodiment has the fixing member 280 (the belt movement restricting section 28) that holds the transfer belt 8 to restrict a movement of the transfer belt 8 toward the backup roller 81 when the transfer belt 8 is pushed by the paper P during secondary transfer. This prevents the movement exceeding 1 mm of the transfer belt 8 toward the backup roller 81 even if the trailing end of the stiff paper P such as thick paper hits the transfer belt 8.

In this way, the transfer belt 8 is held so as not to move toward the backup roller 81 by more than 1 mm during secondary transfer. This prevents formation of a gap that induces electrical discharge between the paper P and the transfer belt 8, leading to suppression of the disorder of the toner image due to the electrical discharge. As a result, the image forming apparatus 1 can form excellent images.

Figure 4:
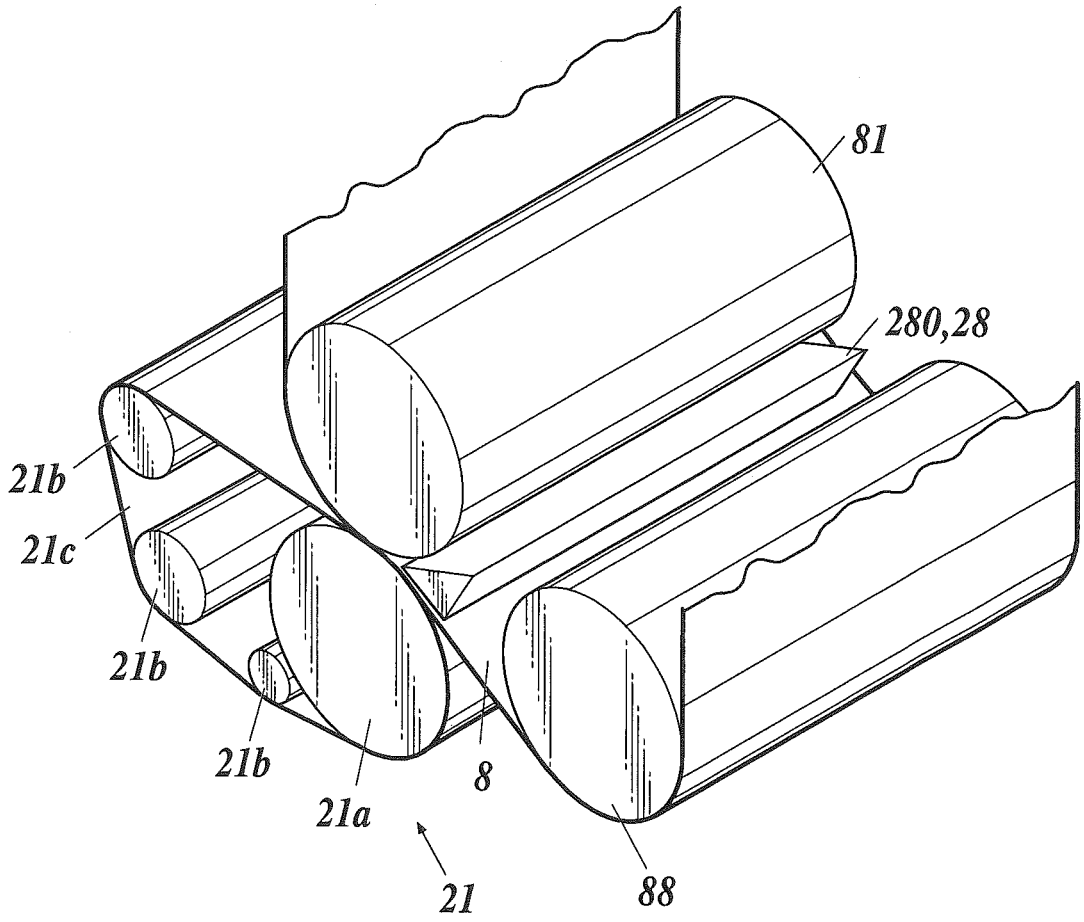
FIG. 4 is a perspective view illustrating the belt movement restricting section of the first embodiment.

The fixing member 280 preferably extends across the full width of the transfer belt 8 as shown in FIG. 4.

Figure 5:
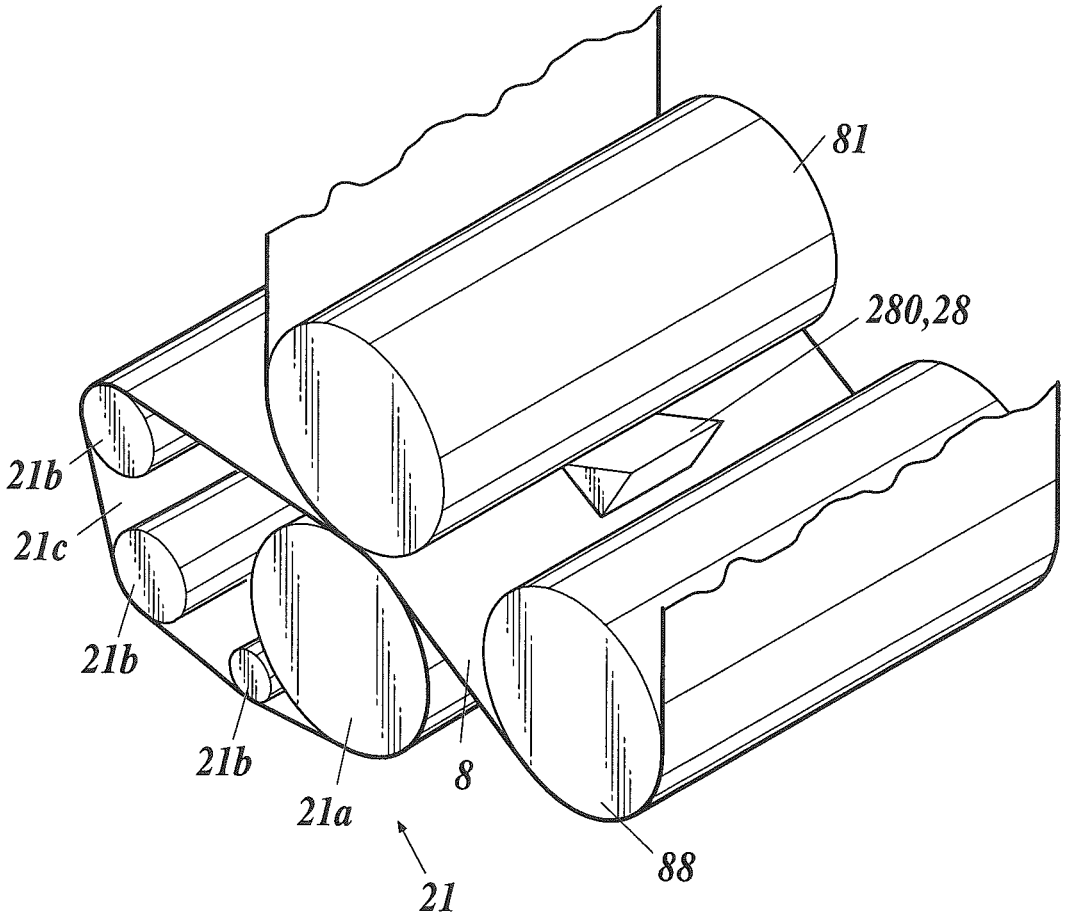
FIG. 5 is a perspective view illustrating a modification of the belt movement restricting section of the first embodiment.

When the stiff paper P, such as thick paper, exits from the guide G on the conveyance path R and when the trailing end of the paper P hits against the transfer belt 8, the shock caused by the hitting may concentrate on the central portion of the transfer belt 8 with respect to the width direction thereof, in some cases. In this case, it is basically sufficient that the deflection of the transfer belt 8 is restricted only in the central portion with respect to the width direction of the belt 8. In such a case, the length of the fixing member 280 can be shorter than the width of the transfer belt 8 as long as the fixing member 280 is provided in the region corresponding to the central portion of the transfer belt 8 with respect to the width direction thereof, as shown in FIG. 5.

The distance between the surface 280*a* of the fixing member 280 and the transfer belt 8 during second transfer is designed to be 1 mm in the above description. However, if appropriate measures are taken to prevent damages on the back of the transfer belt 8 in slidable contact with the surface 280*a* of the fixing member 280, these components can be disposed such that the surface 280*a* of the fixing member 280 comes into contact with the back of the transfer belt 8 (the distance of 0 mm).

Second Embodiment

A second embodiment of the image forming apparatus according to the present invention is now described. The configurations similar to those in the first embodiment are designated by the same numerals and overlapping description is omitted.

Figure 6:
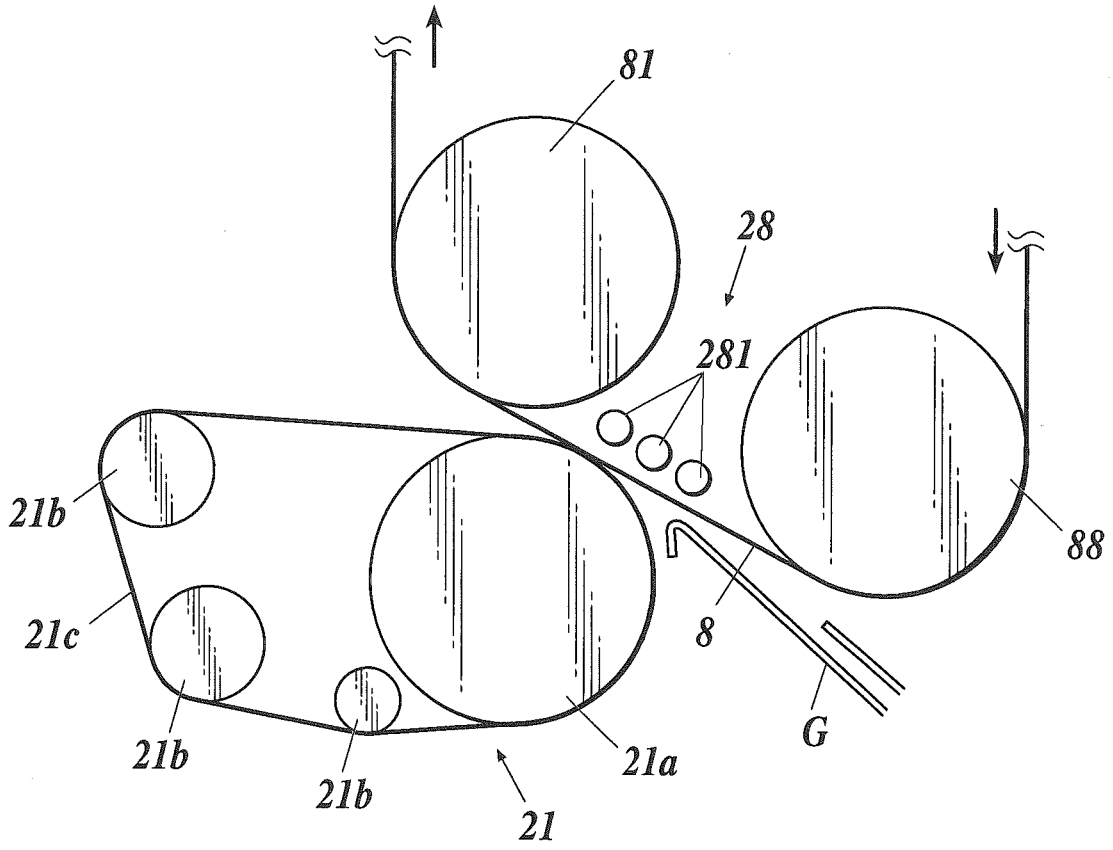
FIG. 6 is an enlarged view illustrating a belt movement restricting section of a second embodiment, showing the position of a secondary transfer roller during a non-secondary-transfer mode.
Figure 7:
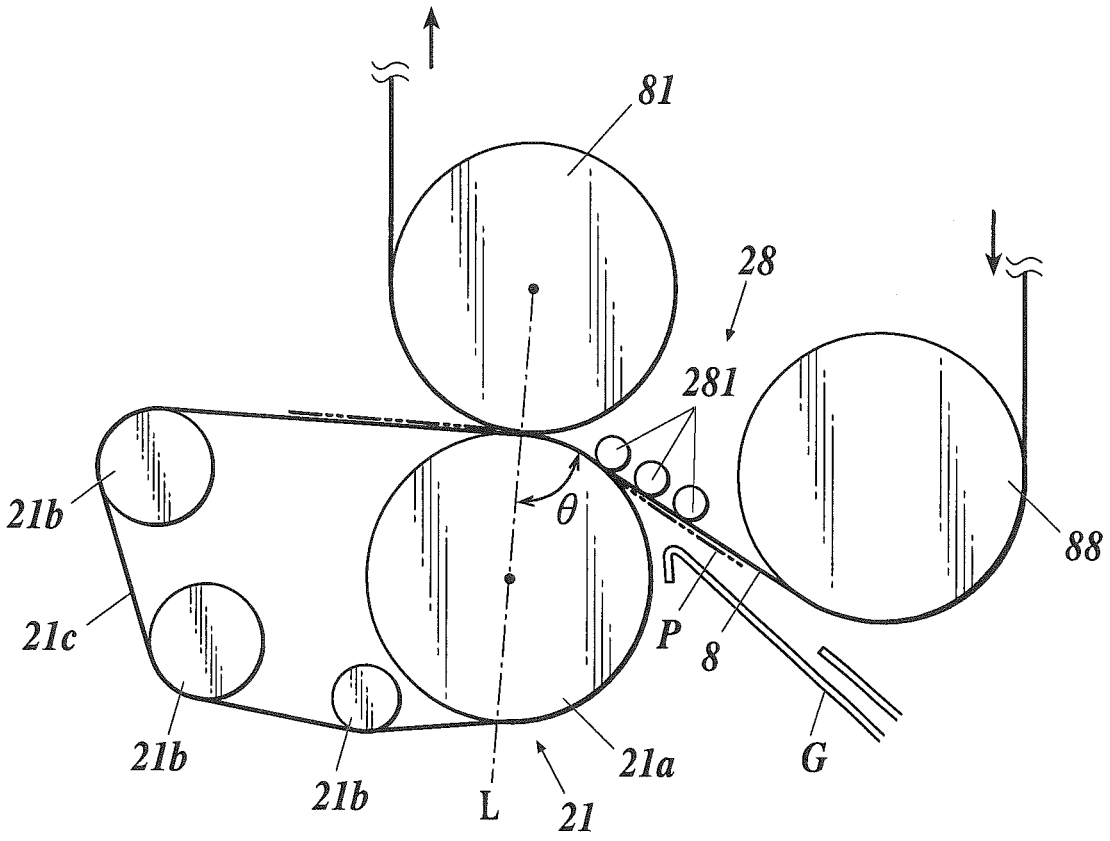
FIG. 7 is an enlarged view illustrating the belt movement restricting section according to the second embodiment, showing the position of the secondary transfer roller during a secondary-transfer mode.

As shown in FIGS. 6 and 7, rollers 281 (belt movement restricting roller) of a belt movement restricting section 28 are provided between a backup roller 81 and a tension roller 88 upstream from the backup roller 81 in the vicinity of the back of a transfer belt 8. A plurality of (three in this embodiment) rollers 281 hold the transfer belt 8 to restrict a movement of the transfer belt 8 toward the backup roller 81 when the transfer belt 8 is pushed by the paper P during secondary transfer. The rollers 281 are separated from the transfer belt 8 with a predetermined amount of space therebetween when a secondary transfer is not performed.

The rollers 281 each composed of, for example, a stainless steel roller having a diameter of 6 mm, and are each rotatably supported by an undepicted support.

As shown in FIG. 6, a secondary transfer section 21 is arranged such that the backup roller 81 is separated from a secondary transfer roller 21*a* during a non-secondary-transfer mode.

Here, the distance between the peripheral surface of each roller 281 and the transfer belt 8 is designed to be, for example, 2 mm.

As shown in FIG. 7, the secondary transfer section 21 is arranged such that the transfer belt 8 is pressed between the backup roller 81 and the secondary transfer roller 21*a* during a secondary-transfer mode.

In this mode, the peripheral surface of each roller 281 is in contact with the back of the transfer belt 8, so that the roller 281 rotates in response to the rotation of the transfer belt 8. Upon contact of the back of the transfer belt 8 with the roller 281, each roller 281 rotates in response to the rotation of the transfer belt 8. This prevents rubbing of the transfer belt 8 against the roller 281, which reduces damages on the back of the transfer belt 8 in contact with the peripheral surface of the roller 281.

In this way, each roller 281 is disposed in contact with the transfer belt 8 in this embodiment. Accordingly, when the secondary transfer section 21 is arranged such that the transfer belt 8 is pressed between the backup roller 81 and the secondary transfer roller 21*a*, and when the paper P is nipped between the transfer belt 8 and the secondary transfer roller 21*a* for secondary transfer of the toner images onto the paper P, the transfer belt 8 is not moved toward the backup roller 81 even if the transfer belt 8 is pushed by the paper P.

Specifically, the paper P, which is conveyed along the conveyance path R, is nipped between the secondary transfer roller 21*a* and the transfer belt 8, and then exits from the guide G on the conveyance path R. Even if the trailing end of the stiff paper P such as thick paper hits the transfer belt 8 as a reaction of its restoration at the timing of the exit, the rollers 281 hold the transfer belt 8 to restrict a movement of the transfer belt 8 toward the backup roller 81. In addition, the transfer belt 8 is not deflected toward the backup roller 81, which eliminates formation of a gap that induces electrical discharge between the paper P and the transfer belt 8. As a result, the disorder of the toner image due to the electrical discharge does not occur, leading to preferable image formation based on excellent secondary transfer.

As described above, the image forming apparatus 1 of the second embodiment has the rollers 281 (the belt movement restricting section 28) that hold the transfer belt 8 to restrict a movement of the transfer belt 8 toward the backup roller 81 when the transfer belt 8 is pushed by the paper P during secondary transfer. This prevents movement of the transfer belt 8 toward the backup roller 81 even if the trailing end of the stiff paper P such as thick paper hits and pushes the transfer belt 8.

In this way, the transfer belt 8 is held so as not to move toward the backup roller 81 during secondary transfer. This prevents formation of the gap that induces electrical discharge between the paper P and the transfer belt 8, leading to suppression of the disorder of the toner image due to the electrical discharge. As a result, the image forming apparatus 1 can form excellent images.

While it is preferable that the rollers 281 of the belt movement restricting section 28 each extend across the full width of the transfer belt 8, such a configuration is not indispensable in some cases. Specifically, when the stiff paper P, such as thick paper, exits from the guide G on the conveyance path R and when the trailing end of the paper P hits against the transfer belt 8, the shock caused by the hitting may concentrate on the central portion of the transfer belt 8 with respect to the width direction thereof, in some cases. In this case, it is basically sufficient that the deflection of the transfer belt 8 is restricted only in the central portion with respect to the width direction of the belt 8. In such a case, the length of each roller 281 can be shorter than the width of the transfer belt 8 as long as the rollers 281 are provided in the region corresponding to the central portion of the transfer belt 8 with respect to the width direction thereof.

Third Embodiment

A third embodiment of the image forming apparatus according to the present invention is now described. The configurations similar to those in the first and second embodiments are designated by the same numerals and overlapping description is omitted.

Figure 8:
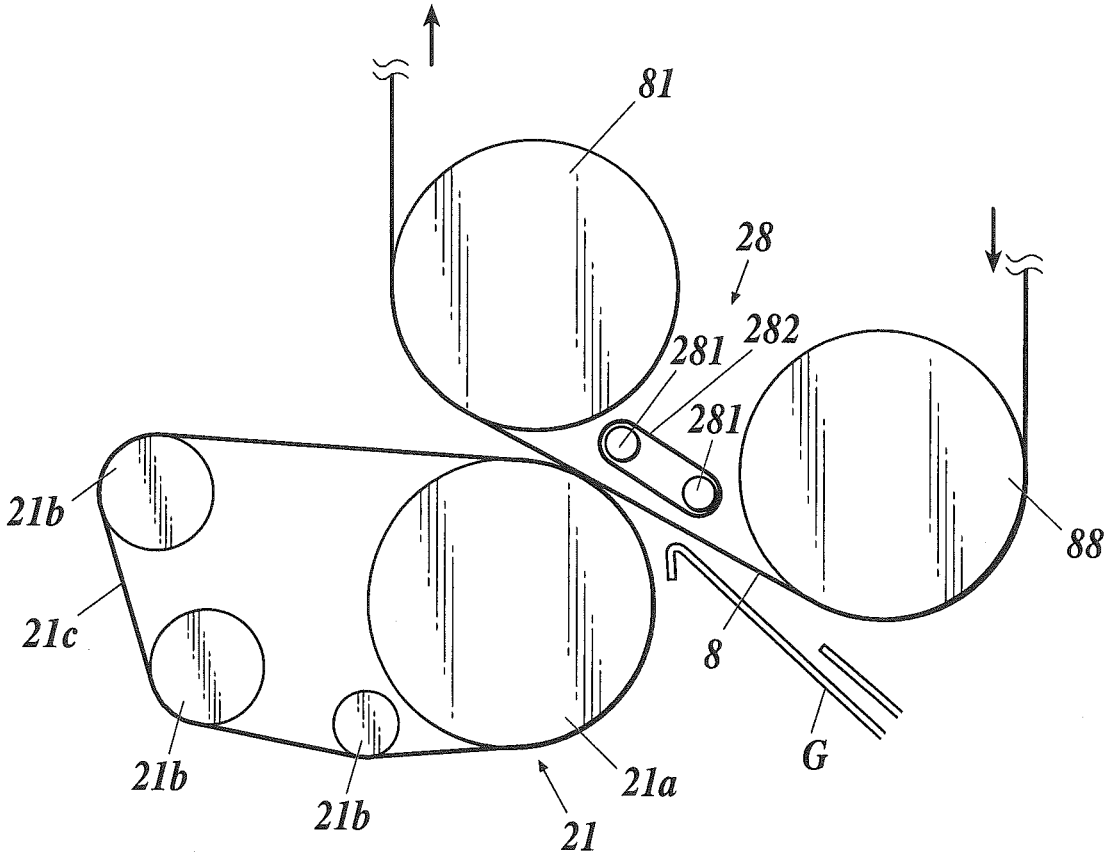
FIG. 8 is an enlarged view illustrating a belt movement restricting section of a third embodiment, showing the position of a secondary transfer roller during a non-secondary-transfer mode.
Figure 9:
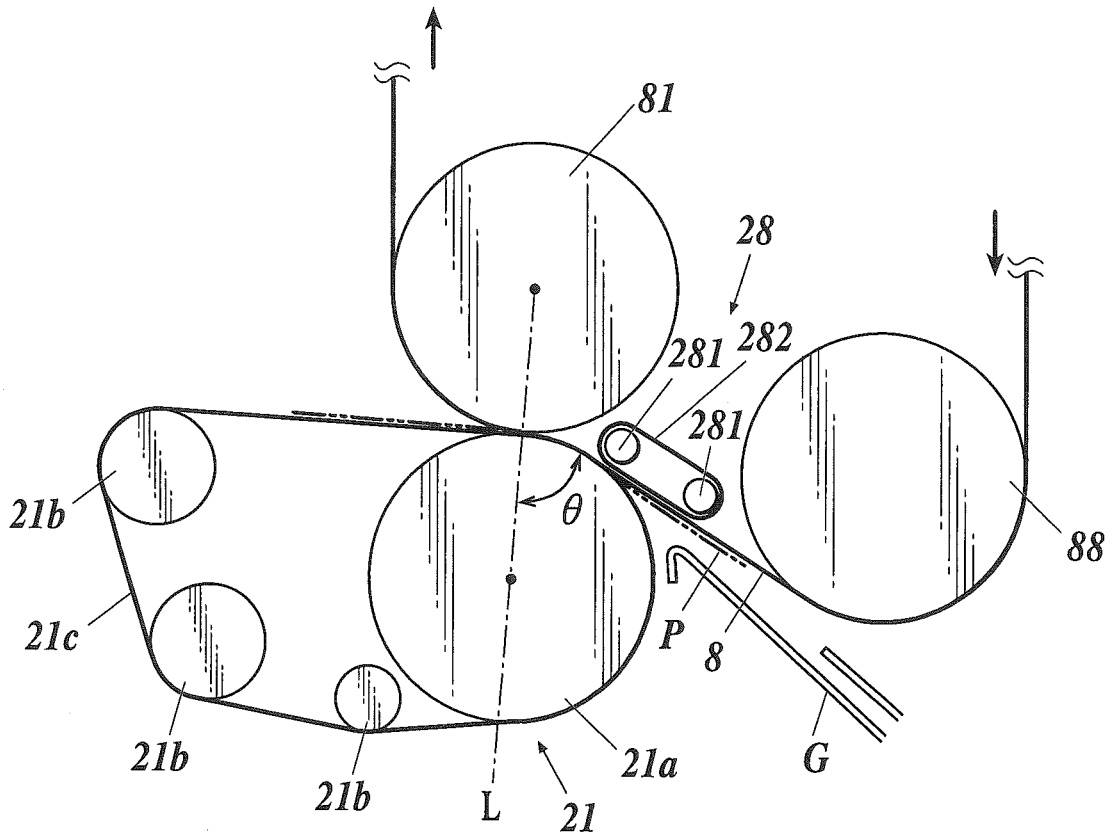
FIG. 9 is an enlarged view illustrating the belt movement restricting section of the third embodiment, showing the position of the secondary transfer roller during a secondary-transfer mode.

As shown in FIGS. 8 and 9, rollers 281 and a belt 282 of a belt movement restricting section 28 are provided between a backup roller 81 and a tension roller 88 upstream from the backup roller 81 in the vicinity of the back of a transfer belt 8.

The rollers 281 each composed of, for example, a stainless steel roller having a diameter of 6 mm, and are each rotatably supported by an undepicted support.

The belt 282 is an endless belt rotatably stretched over the two rollers 281, and is formed, for example, by molding of an insulating resin material.

The belt movement restricting section 28 including the belt 282 stretched over the two rollers 281 holds the transfer belt 8 to restrict a movement of the transfer belt 8 toward the backup roller 81 when the transfer belt 8 is pushed by the paper P during secondary transfer. The belt movement restricting section 28 (the rollers 281 and belt 282) is separated from the transfer belt 8 with a predetermined amount of space therebetween when a secondary transfer is not performed.

As shown in FIG. 8, a secondary transfer section 21 is arranged such that a backup roller 81 is separated from the secondary transfer roller 21*a* during the non-secondary-transfer mode.

In this mode, the distance between the peripheral surface of the belt 282 and the transfer belt 8 is designed to be, for example, 2 mm.

As shown in FIG. 9, the secondary transfer section 21 is arranged such that the transfer belt 8 is pressed between the backup roller 81 and the secondary transfer roller 21*a* during the secondary-transfer mode.

In this state, the peripheral surface of the belt 282 comes into contact with the back of the transfer belt 8, so that the belt 282 and the rollers 281 rotate in response to the rotation of the transfer belt 8. Upon contact of the back of the transfer belt 8 with the belt 282, the belt 282 and the rollers 281 rotate in response to the rotation of the transfer belt 8. This prevents rubbing of the transfer belt 8 against the belt 282, which reduces damages on the back of the transfer belt 8 in contact with the peripheral surface of the belt 282.

In this way, the belt 282 is disposed in contact with the transfer belt 8 in this embodiment. Accordingly, when the secondary transfer section 21 is arranged such that the transfer belt 8 is pressed between the backup roller 81 and the secondary transfer roller 21*a*, and when the paper P is nipped between the transfer belt 8 and the secondary transfer roller 21*a* for secondary transfer of the toner images onto the paper P, the transfer belt 8 is not moved toward the backup roller 81 even if the transfer belt 8 is pushed by the paper P.

Specifically, the paper P, which is conveyed along the conveyance path R, is nipped between the secondary transfer roller 21*a* and the transfer belt 8, and then exits from the guide G on the conveyance path R. Even if the trailing end of the stiff paper P such as thick paper hits the transfer belt 8 as a reaction of its restoration at the timing of the exit, the belt 282 and the rollers 281 hold the transfer belt 8 to restrict a movement of the transfer belt 8 toward the backup roller 81. In addition, the transfer belt 8 is not deflected toward the backup roller 81, which eliminates formation of the gap that induces electrical discharge between the paper P and the transfer belt 8. As a result, the disorder of the toner image due to the electrical discharge does not occur, leading to preferable image formation based on excellent secondary transfer.

As described above, the image forming apparatus 1 of the third embodiment has the belt 282 and the rollers 281 (the belt movement restricting section 28) that hold the transfer belt 8 to restrict a movement of the transfer belt 8 toward the backup roller 81 when the transfer belt 8 is pushed by the paper P during secondary transfer. This prevents movement of the transfer belt 8 toward the backup roller 81 even if the trailing end of the stiff paper P such as thick paper hits and pushes the transfer belt 8.

In this way, the transfer belt 8 is held so as not to move toward the backup roller 81 during secondary transfer. This prevents formation of a gap that induces electrical discharge between the paper P and the transfer belt 8, leading to suppression of the disorder of the toner image due to the electrical discharge. As a result, the image forming apparatus 1 can form excellent images.

Figure 10:
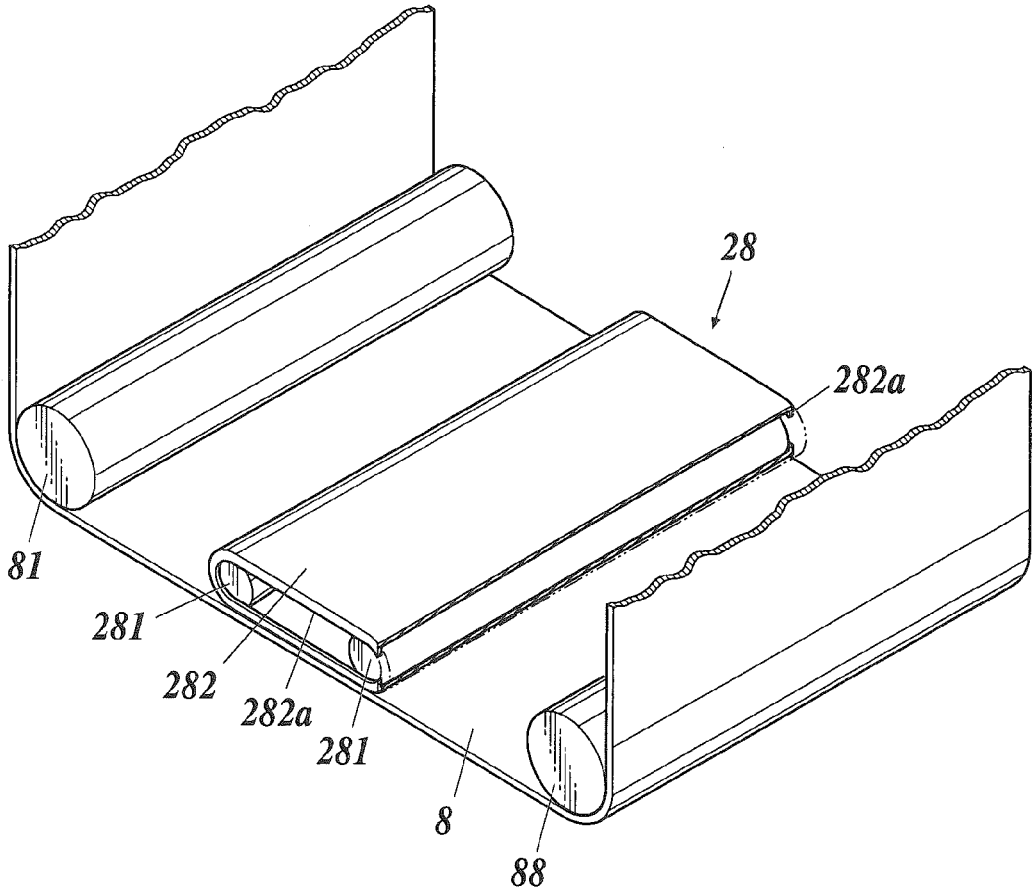
FIG. 10 is a perspective view illustrating the belt movement restricting section of the third embodiment.

As shown in FIG. 10, it is preferable that ribs 282*a* be provided on inner surface of the belt 282 at two ends thereof for the third embodiment. The ribs 282*a* are in abutting contact with the two ends, respective, of each roller 281. The ribs 282*a* each have, for example, a thickness of 2 mm and a width of 5 mm. The ribs 282*a* on the two ends of the belt 282 rotate in abutting contact with the two ends of each roller 281. As a result, the belt 282 rotates in accordance with rotation of the transfer belt 8 without meandering.

Figure 11:
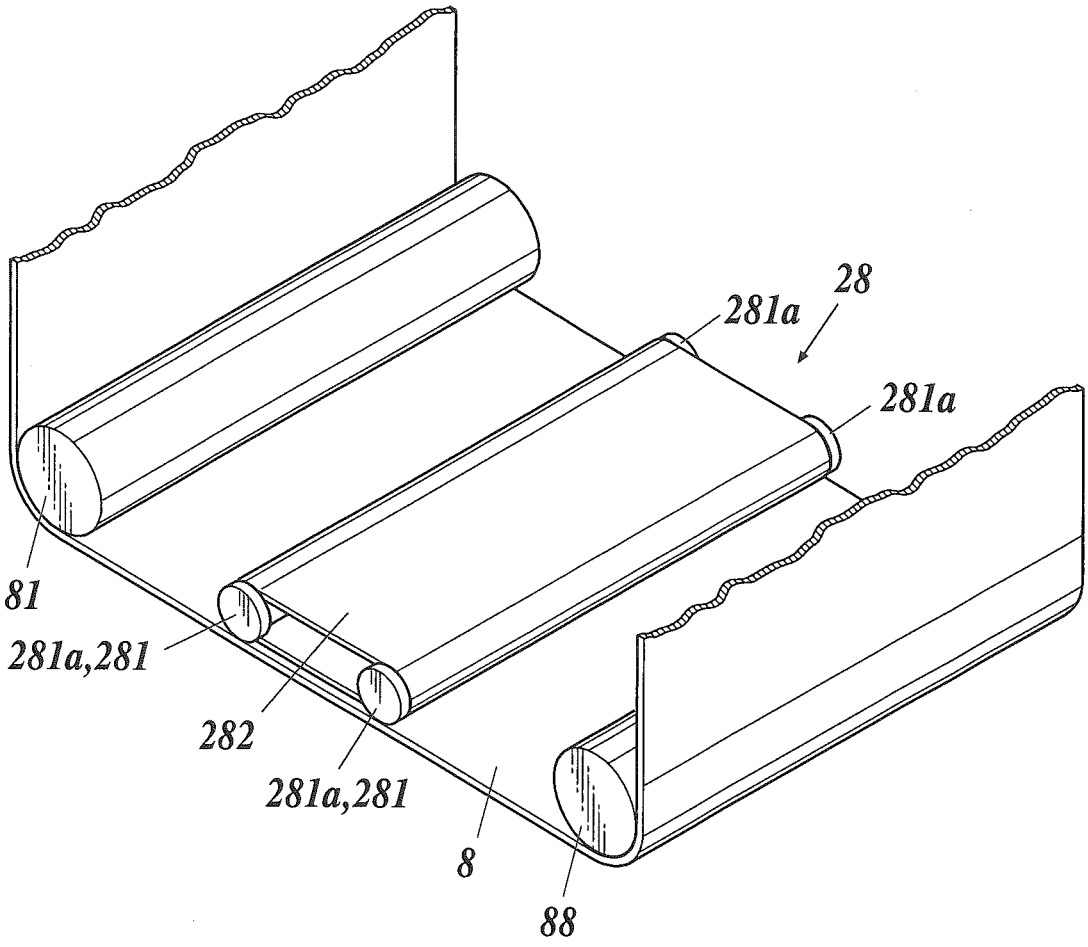
FIG. 11 is a perspective view illustrating a modification of the belt movement restricting section of the third embodiment.

Alternatively, flanges 281*a* may be provided at the two ends of each roller 281 of the belt movement restricting section 28 of the third embodiment, as shown in FIG. 11. The belt 282 rotates with its two ends being in abutting contact with the flanges 281*a* at the two ends of each roller 281. As a result, the belt 282 rotates in accordance with rotation of the transfer belt 8 without meandering.

While it is preferable that the belt 282 and the rollers 281 of the belt movement restricting section 28 each extend across the full width of the transfer belt 8, such a configuration is not indispensable in some cases. Specifically, when the stiff paper P, such as thick paper, exits from the guide G on the conveyance path R and when the trailing end of the paper P hits against the transfer belt 8, the shock caused by the hitting may concentrate on the central portion of the transfer belt 8 with respect to the width direction thereof, in some cases. In this case, it is basically sufficient that the deflection of the transfer belt 8 is restricted only in the central portion with respect to the width direction of the belt 8. In such a case, the length of the belt 282 and that of each roller 281 can be shorter than the width of the transfer belt 8 as long as the belt 282 and rollers 281 are provided in the region corresponding to the central portion of the transfer belt 8 with respect to the width direction thereof.

The present invention is not limited to the above-described embodiments, and appropriate modifications or alterations may be made within the scope without departing from the spirit of the invention.

The entire disclosure of Japanese Patent Application No. 2011-098896 filed on Apr. 27, 2011 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An image forming apparatus comprising:

a transfer belt having a first surface on which a toner image is primarily transferred, the transfer belt rotating in a predetermined direction;

a pressure receiving roller over which the transfer belt is stretched;

a secondary transfer roller that presses the transfer belt against the pressure receiving roller; and a belt movement restricting section disposed in a vicinity of a second surface of the transfer belt, the second surface being opposite from the first surface, wherein when the transfer belt is pressed between the pressure receiving roller and the secondary transfer roller, and paper is nipped between the transfer belt and the secondary transfer roller for secondary transfer of the toner image onto the paper, an angle defined by a portion, upstream from the secondary transfer roller, of the first surface and an imaginary line connecting an axis of the pressure receiving roller with an axis of the secondary transfer roller is less than 90 degrees;

when the secondary transfer is not performed, the belt movement restricting section is separated from the transfer belt with a predetermined amount of space therebetween; and during the secondary transfer, the belt movement restricting section holds the transfer belt to restrict a movement of the transfer belt toward the pressure receiving roller when the transfer belt is pushed by the paper.

2. The image forming apparatus according to claim 1, wherein the transfer belt comes in contact with the belt movement restricting section while the transfer belt is pressed between the pressure receiving roller and the secondary transfer roller.

3. The image forming apparatus according to claim 1, wherein the belt movement restricting section includes a fixing member having a cross-sectional shape that allows the fixing member to withstand a push given by the transfer belt when the fixing member comes in contact with the transfer belt.

4. The image forming apparatus according to claim 1, wherein the belt movement restricting section includes a belt movement restricting roller that rotates in response to rotation of the transfer belt when the belt movement restricting roller comes in contact with the transfer belt.

5. The image forming apparatus according to claim 1, wherein the belt movement restricting section includes an endless belt and a belt movement restricting roller, the endless belt being stretched over the belt movement restricting roller, and the endless belt rotating in response to rotation of the transfer belt when the endless belt comes in contact with the transfer belt.

6. The image forming apparatus according to claim 1, wherein the belt movement restricting section extends across a full width of the transfer belt.

7. The image forming apparatus according to claim 1, wherein the belt movement restricting section is disposed at a position corresponding to a central portion of the transfer belt with respect to a width direction thereof.

* * * * *